US006688915B2

(12) United States Patent
Moriwake et al.

(10) Patent No.: US 6,688,915 B2
(45) Date of Patent: Feb. 10, 2004

(54) ELECTRIC CONNECTOR HAVING CONDUCTIVE INNER AND OUTER SHELLS SECURELY FASTENED TO EACH OTHER

(75) Inventors: Ryo Moriwake, Izumiotsu (JP); Takashi Tsutsui, Nissin (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/281,434

(22) Filed: Oct. 24, 2002

(65) Prior Publication Data

US 2003/0082951 A1 May 1, 2003

(30) Foreign Application Priority Data

Oct. 29, 2001 (JP) ..... 2001-331336

(51) Int. Cl.[7] ..... H01R 13/648
(52) U.S. Cl. ..... 439/607; 439/939
(58) Field of Search ..... 439/607–610, 439/701, 353, 357, 939

(56) References Cited

U.S. PATENT DOCUMENTS 6,053,772 A * 4/2000 Aizawa et al. ..... 439/607
6,346,009 B1 * 2/2002 Lin ..... 439/607
6,364,707 B1 * 4/2002 Wang ..... 439/607

FOREIGN PATENT DOCUMENTS

JP 11-054196 2/1999
JP 2000260515 9/2000

OTHER PUBLICATIONS

Universal Serial Bus Specification, USB 8, Revision 2.0; Compaq, Hewlett–Packard, Intel, et al.; Apr. 27, 2000, cover sheets and Chapter 6, pp. 85 to 117.

HI–34, ISO 9002 SGS; CONICON, Chu Yuen Enterprise Co., Ltd.; 3 pages; Japanese Patent Office public known material No. HD12005786, received Dec. 3, 1999.

U. S. Design Application No. 29/161,086, filed on May 21, 2002, title: Electrical Connector; pp. 1 to 5 and 20 sheets of drawings.

* cited by examiner

*Primary Examiner*—Son V. Nguyen
(74) *Attorney, Agent, or Firm*—W. F. Fasse; W. G. Fasse

(57) ABSTRACT

An electric connector includes an insulating body, wherein connection parts to be connected with counterpart connectors are arranged in the height direction, a conductive outer wall shell put on the body and having an opening on the front side, and a conductive inner wall shell for partitioning the connection parts. Both the ends, in the width direction, of the intermediate part of the inner wall shell are extended to fasten to the outer wall shell, and at least one end is formed into an approximately-U-shaped thrust-in part rising from the front side toward the rear side when seen in the width direction, and two top ends on the rear side of the thrust-in part are fastened into two slits formed in the outer wall shell. Thereby, the coupling strength between the outer and inner wall shells and the anti-prying strength against prying forces exerted by counterpart connectors are enhanced significantly, and the electric connector is reliably prevented from being damaged.

4 Claims, 8 Drawing Sheets

ELECTRIC CONNECTOR HAVING CONDUCTIVE INNER AND OUTER SHELLS SECURELY FASTENED TO EACH OTHER

BACKGROUND OF THE INVENTION

1. Field of the Invention

The present invention belongs to a field of electric connectors which are covered by shells for shielding and wherein connection parts for connecting with counterpart connectors are provided in multiple stages, and in particular, relates to the coupling structure of the shells for shielding.

2. Related Art

As for electric connectors of this kind, for example, Japanese Patent unexamined publication gazette 2000-260515 disclosed in the past an electric connector comprising a body made of an insulator, and an outer wall shell and an inner wall shell both being made of a conductor. In this body, on the front side thereof, connection parts having terminals and being to be connected with counterpart connectors are arranged in stages in the height direction. The outer wall shell is put on the body to shield the connection parts and is provided with an opening on the front side. The inner wall shell is provided to partition the connection parts and comprises an intermediate part forming the front side face and partition parts extending from both sides, in the height direction, of the intermediate part towards the rear side. Both the ends, in the width direction, of the intermediate part of the inner wall shell are provided with a convex part extending in the width direction. These convex parts are fastened with concaved parts formed in the front side end of the outer wall shell, and the coupling strength between the outer wall shell and the inner wall shell is secured by them.

When counterpart connectors are connected to this electric connector and the electric connector is subjected to prying forces exerted by the counterpart connectors, the coupling parts of the outer wall shell and the inner wall shell may be damaged by these prying forces. It, therefore, is keenly desired to enhance the coupling strength of these members as much as possible.

SUMMARY OF THE INVENTION

The present invention was made in view of these points, and its primary objective is to significantly enhance the coupling strength between the outer wall shell and the inner wall shell by deeply fastening at least one end, in the width direction, of the intermediate part of the inner wall shell to the outer wall shell at two locations being staggered in the height direction of the outer wall shell and, in turn, to enhance the anti-prying strength against prying forces exerted by the counterpart connectors and reliably prevent the electric connector from being damaged.

To accomplish the above-mentioned objective, the electric connector according to the present invention is an electric connector comprising a body made of an insulator, wherein on the front side, connection parts having terminals and being to be connected with counterpart connectors are arranged in stages in the height direction, an outer wall shell made of a conductor, the outer wall shell being to be put on the body to shield the connection parts and having an opening on the front side, and an inner wall shell made of a conductor, the inner wall shell being provided to partition the connection parts and comprising an intermediate part forming the front side face and partition parts extending from both ends, in the height direction, of the intermediate part towards the rear side, both the ends, in the width direction, of the intermediate part of the inner wall shell are extended and fastened to the outer wall shell, and at least one end is formed into an approximately-U-shaped thrust-in part rising from the front side towards the rear side when seen in the width direction, and two top ends on the rear side of this thrust-in part are fastened into two slits formed in the outer wall shell.

In this electric connector, as the inner wall shell is fastened to the outer wall shell at both ends, in the width direction, of the intermediate part thereof, a coupling strength between the outer wall shell and the inner wall shell can be secured. In this case, as two top ends of a thrust-in part being formed on at least one end, in the width direction, of the intermediate part of the inner wall shell are fastened into the two slits of the outer wall shell, the area of the fastening parts is greater than that of the conventional connectors, and in turn the coupling strength between the outer wall shell and the inner wall shell is improved proportionately. As a result, the anti-prying strength against prying forces that are exerted by the counterpart connectors is enhanced, and the electric connector is reliably prevented from being damaged. Moreover, when the outer wall shell is fitted onto the body, the coupling strength between the outer wall shell and the body will be enhanced much more, and the anti-prying strength against the prying forces exerted by the counterpart connectors will be increased much more and the electric connector will be more reliably prevented from being damaged.

PREFERRED EMBODIMENTS OF THE INVENTION

In the following, some embodiments of the present invention will be described. FIG. 1 through FIG. 8 show the first embodiment of the electric connector. This electric connector is of the two pole type, namely, an electric connector to which two counterpart connectors can be connected. The number of poles of the present invention, however, is not limited by this embodiment, and the present invention is applicable to any electric connectors having two or more poles, namely, electric connectors of the multiple stage type. This electric connector is used, for example, by mounting it on a printed circuit board, but the mode of its use is not limited to that.

This electric connector comprises a body 100 made of an insulator, an outer wall shell 200 for shielding, which is provided on the body 100 and is made of a conductor, and an inner wall shell 300 for shielding, which is provided on the body and is made of a conductor.

Figure 1:
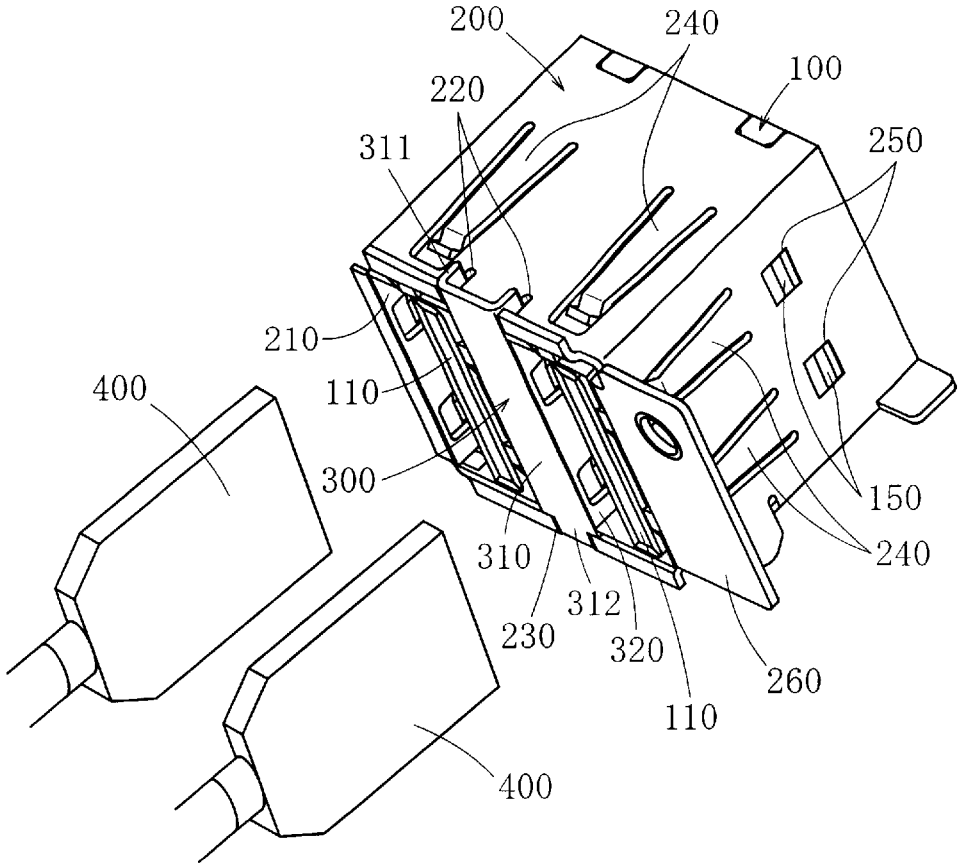
FIG. 1 is a perspective view of the electric connector of the first embodiment.
Figure 2:
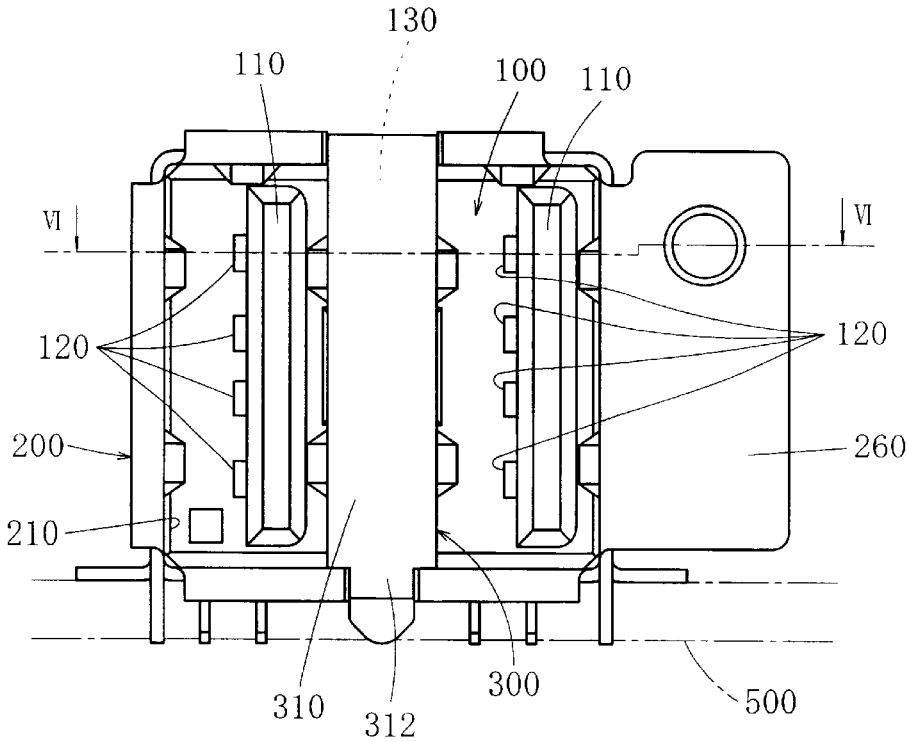
FIG. 2 is a figure of the above-mentioned electric connector seen from the front side.
Figure 3:
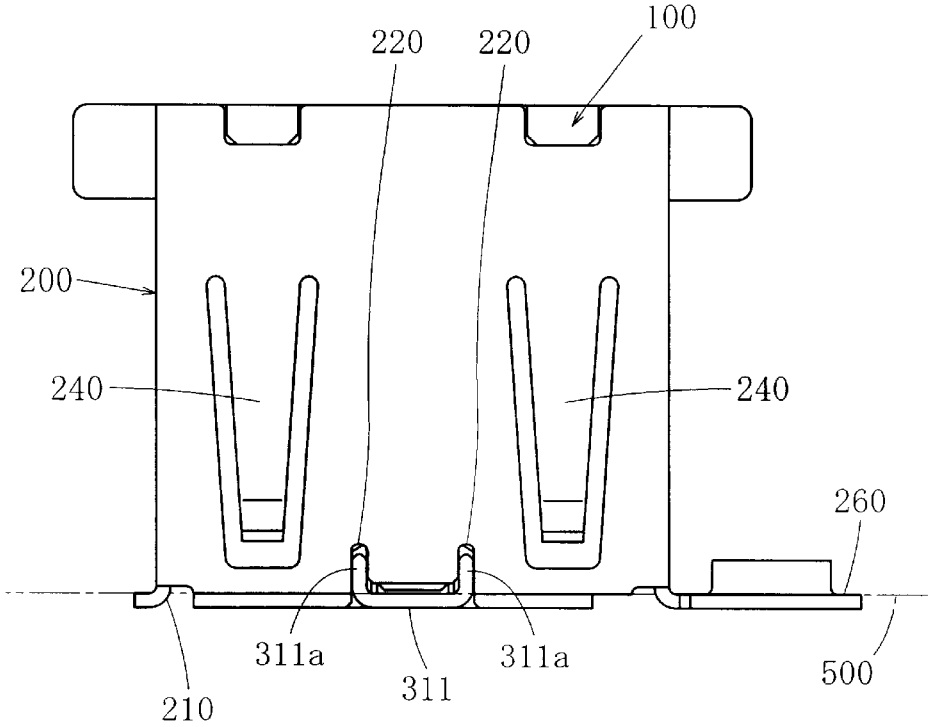
FIG. 3 is a figure of the above-mentioned electric connector seen from one side in the width direction thereof.
Figure 4:
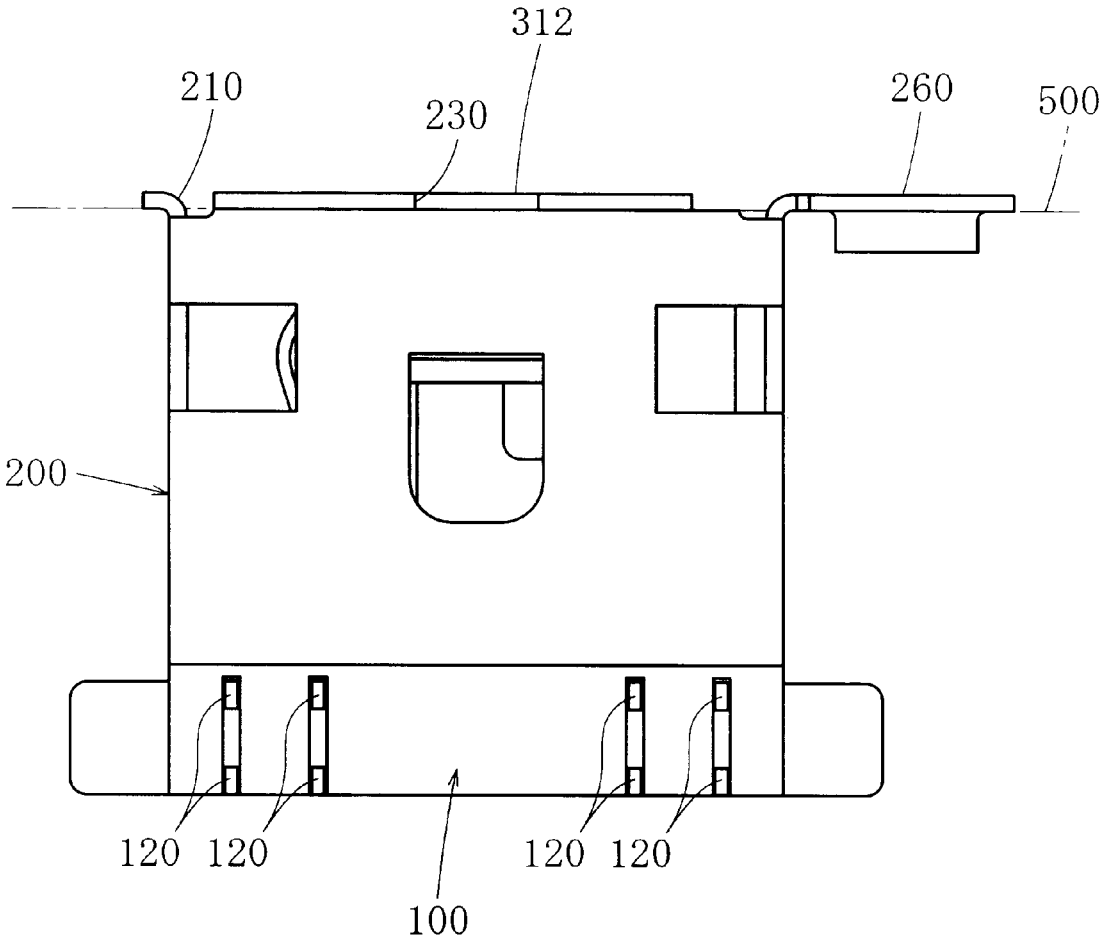
FIG. 4 is a figure of the above-mentioned electric connector seen from the other side in the width direction thereof.
Figure 5:
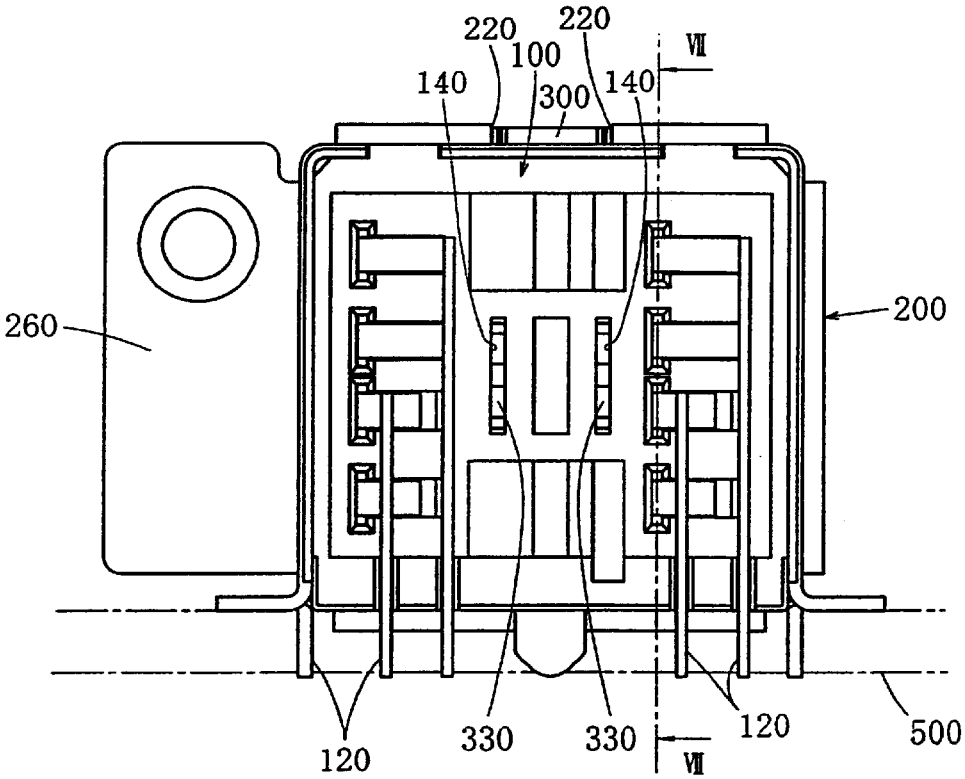
FIG. 5 is a figure of the above-mentioned electric connector seen from the rear side.
Figure 6:
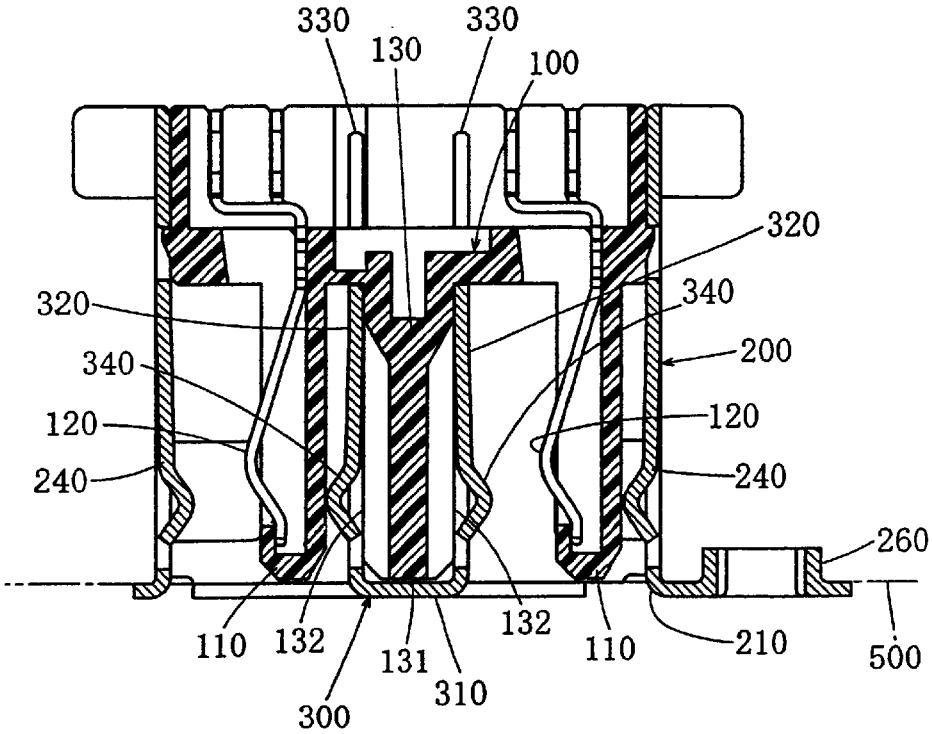
FIG. 6 is a sectional view along the line VI—VI of FIG. 2.
Figure 7:
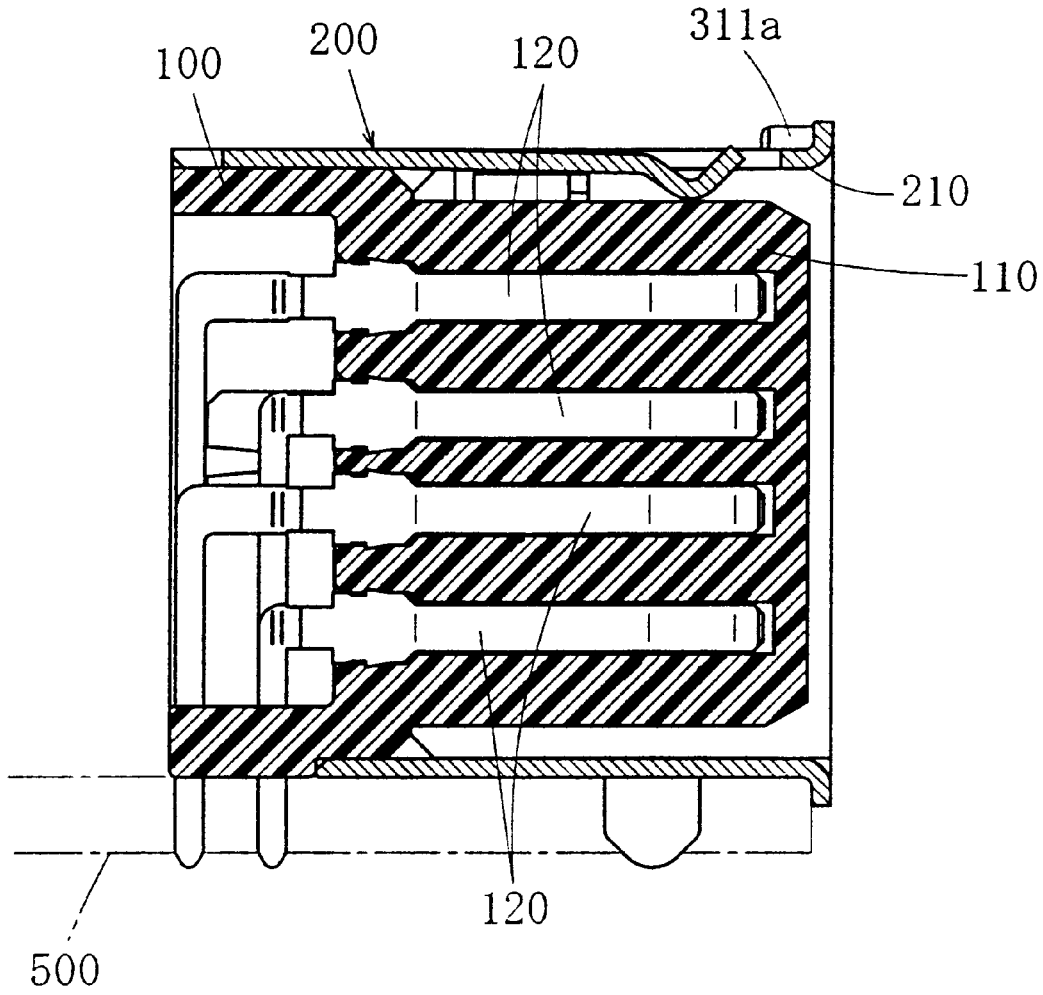
FIG. 7 is a sectional view along the line VII—VII of FIG. 5.
Figure 8:
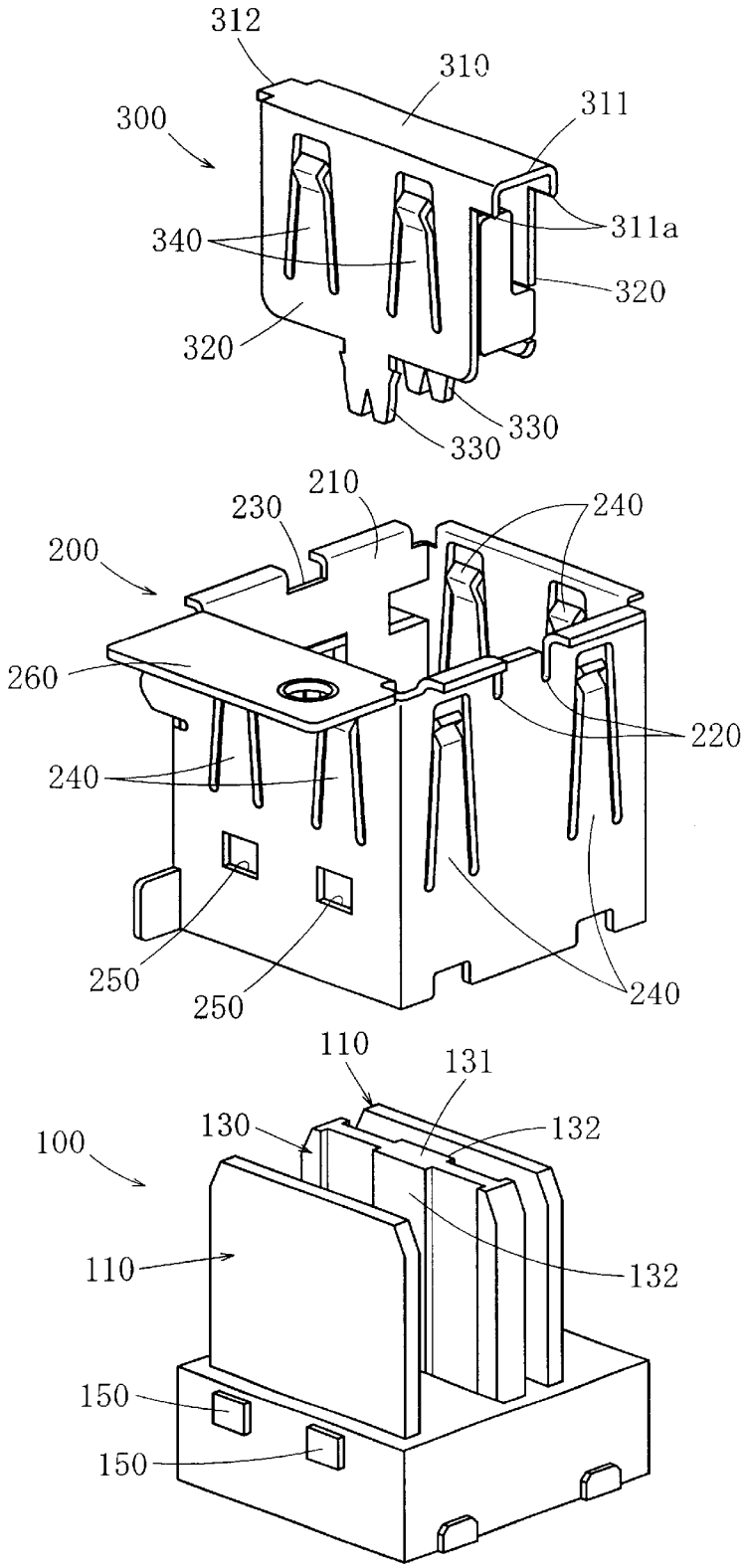
FIG. 8 is an exploded perspective view of the above-mentioned electric connector.

On the front side of the body 100, connection parts 110, to which counterpart connectors 400 are to be connected, are arranged in the height direction. In FIG. 3, the lower side of the figure shows the front side of the respective members, and the upper side of the figure shows the rear side of the respective members. In FIG. 2, the left-right direction of the figure shows the height direction of the respective members, and the up-down direction of the figure shows the width direction of the respective members. The connection parts 110 can take any form provided they can exhibit functions of connecting with counterpart connectors 400. In this embodiment, the connection parts 110 are formed into plates and extend from the base of the body 100 towards the front side, and the connection is made by fitting the counterpart connectors 400 with the connection parts 110 through fit-in ports at the top end. Each connection part 110 is provided with terminals 120, and the electric connection is made when this terminal 120 contacts a terminal (not illustrated) of the counterpart connector 400. Each terminal 120 is led out of the body 100 so that it can be connected to a printed circuit board or the like. The body 100 is provided with a partition wall 130 which partitions the connection parts 110. The partition wall 130 is of a plate shape and extends from the base of the body 100 towards the front side between the connection parts 110. The present invention includes embodiments wherein the male-female relationship between the connection parts of the electric connector and the connection parts of the counterpart connectors is reversed.

The outer wall shell 200 is put on the body 100 to shield the connection parts 110, and the outer wall shell 200 fits with the body 100 by a contacting force of a certain level and will not slip off easily. Accordingly, the outer wall shell 200 is formed into a shape which can contain the body 100 in it, for example, a box or a tube. Mounting the outer wall shell 200 on the body 100 is done by fitting the outer wall shell 200 onto the base of the body 100 from the outside. The outer wall shell 200 has an opening 210 on the front side, and the counterpart connectors 400 are to be received through this opening 210.

The inner wall shell 300 is provided to partition the connection parts 110 and comprises an intermediate part 310, which forms the front side face, and partition parts 320, 320, which extend from both the ends, in the height direction, of the intermediate part 310 towards the rear side. The inner wall shell 300 is put on the partition wall 130 so that the intermediate part 310 shields the front side face 131 of the partition wall 130 and the partition parts 320 shield both faces 132, 132, in the height direction, of the partition wall 130. The inner wall shell 300 fits with the partition wall 130 with a contacting force of a certain level to clamp the partition wall 130 with the partition parts 320, 320, thus the inner wall shell 300 will not slip off easily.

As shown in FIG. 1 through FIG. 4 and FIG. 7, both the ends, in the width direction, of the intermediate part 310 of the inner wall shell 300 are extended so that they protrude outwardly beyond both the ends, in the width direction, of the body 100, and both the ends of the intermediate part 300 are fastened to the outer wall shell 200. One end, in the width direction, of the intermediate part 310 is formed into an approximately-U-shaped thrust-in part 311 rising from the front side towards the rear end when seen in the width direction, and two top ends 311*a* are formed on the rear side of this thrust-in part 311. Two slits 220, which are cut towards the rear side, are formed in the front-side edge of one wall, in the width direction, of the outer wall shell 200. The two top ends 311*a* of the thrust-in part 311 are fastened to these two slits 220. The other end, in the width direction, of the intermediate part 310 is formed into a fit-in tongue 312, which is a flat-plate-shaped protrusion. A concaved part 230, which concaves towards the rear side, is formed in the front-side edge of the other wall, in the width direction, of the the outer wall shell 200. The fit-in tongue 312 fits in this concaved part 230.

On the rear-side edge of the partition part 320 of the inner wall shell 300, a press-in protrusion 330, which extends towards the rear side and is to be pressed into the body 100, is provided. A press-in hole 140 opens in the base of the body 100. In the present embodiment, each of the two partition parts 320 is provided with a press-in protrusion 330, and two press-in holes 140 open in the base of the body 100.

240 denotes a spring which is provided, as occasion demands, on the outer wall shell 200, and the spring contacts the counterpart connector 400 to hold it. A spring 340 of the same kind is also provided, as occasion demands, on the inner wall shell 300. 250 denotes a fastening hole which is provided in the outer wall shell 200 as occasion demands. The fastening hole 250 fits with a fastening protrusion 150 which is provided, as occasion demands, on the body 100 so as to enhance the fit-in strength between the outer wall shell 200 and the body 100. 260 denotes a flange which is provided, as occasion demands, on the outer wall shell 200. It is, for example, a part to be screwed down onto a casing or the like of the product onto which the electric connector is assembled. In this embodiment, the flange 260 is provided in continuity to one edge, in the height direction, of the outer wall shell 200, but it may be provided on the other edge or on any other part.

A typical mode of use of this electric connector is one wherein the electric connector is mounted on a printed circuit board or the like with a face of the electric connector facing the board or the like. In such cases, when the electric connector is to be mounted on a printed circuit board or the like with one face, in the width direction, of the electric connector facing the board or the like, if both the ends, in the width direction, of the intermediate part 310 of the inner wall shell 300 protrude out of both the ends, in the width direction, of the body and more over out of both the ends, in the width direction, of the outer wall shell 200, the electric connector will be mounted on the printed circuit or the like in such a way that the greater part of the face is within the end of the printed circuit board or the like and just the front side having the opening 210 protrudes outwards by a small length from the printed circuit board or the like so that the protruding portions should not interfere with the printed circuit board or the like. In such a case, if the electric connector is mounted in such a way that of the both ends of the inner wall shell 300, the fit-in tongue 312 rather than the thrust-in part 311 faces the printed circuit board or the like, the interference between the electric connector and the printed circuit board or the like can be easily avoided because the fit-in tongue 312, unlike the thrust-in part 311, does not have parts rising from the front side towards the rear side, and more over, the length of protrusion of the electric connector out of the printed circuit board or the like can be shortened as much as possible. FIG. 2 through FIG. 7 show such modes of use of the electric connector. In these figures, 500 denotes a printed circuit board or the like.

Accordingly, in the case of the electric connector of the first embodiment, as the inner wall shell 300 is fastened to the outer wall shell 200 at both the ends, in the width direction, of the intermediate part 310, the coupling strength between the outer wall shell 200 and the inner wall shell 300 is ensured. In that case, as the two top ends 311*a*, 311*a* of the thrust-in part 311, which is formed on at least one end of the two ends, in the width direction, of the intermediate part 310 of the inner wall shell 300, are fastened to two slits 220, 220 of the outer wall shell 200, the area of the fastening parts is greater than that of a conventional product, and the coupling strength between the outer wall shell 200 and the inner wall shell 300 is enhanced proportionally. Hence the anti-prying strength against prying forces exerted by the counterpart connectors 400 is enhanced, and the electric connector is reliably prevented from being damaged. In particular, even if the inner wall shell 300 is subjected to a force which would shift it towards the front side from its regular fastened position, the fastening relationship between both the shells 200, 300 can be maintained stably. In the case of the first embodiment, the top end 311*a* of the thrust-in part 311 and the slit 220 are fastened to each other when the former is inserted into the latter. Another fastening mode is one wherein they are fastened to each other when the top end 311*a* is inserted into the slit 220 by a certain force, and the present invention includes such a mode.

The present invention includes embodiments wherein the outer wall shell is put on the body and the outer wall shell is fastened to the body so that the outer wall shell does not slip off the body. Of various embodiments of the present invention, in the electric connector of the first embodiment, the body 100 is fitted in the outer wall shell 200. With this arrangement, the coupling strength between the outer wall shell 200 and the body 100 is enhanced further more, and the anti-prying strength against the prying forces exerted by the counterpart connectors 400 is improved much more, and the electric connector is more reliably prevented from being damaged.

The present invention includes embodiments wherein the body is not provided with any partition wall. Of various embodiments of the present invention, in the electric connector of the first embodiment, the body 100 is provided with a partition wall 130 which partitions the connection parts 110, and the inner wall shell 300 is put on the partition wall 130 so that the intermediate part 310 shields the front-side face 131 of the partition wall 130 and the partition parts 320, 320 shield both the faces 132, 132, in the height direction, of the partition wall 130. With this arrangement, when the inner wall shell 300 is to be fitted on the outer wall shell 200, the inner wall shell 300 will be guided by the partition wall 130 to advance from the front side towards the rear side. Thus the ease in fitting the inner wall shell 300 on the outer wall shell 200 is improved.

The present invention includes embodiments wherein the inner wall shell is put on and fastened to the partition wall to prevent the inner wall shell from slipping off. Of various embodiments of the present invention, in the electric connector of the first embodiment, the partition wall 130 is fitted in the inner wall shell 300. With this arrangement, the coupling strength between the inner wall shell 300 and the body 100 is enhanced further more, and the anti-prying strength against the prying forces exerted by the counterpart connectors 400 is enhanced much more, and the electric connector is more reliably prevented from being damaged.

The present invention includes embodiments wherein the partition part of the inner wall shell is not provided with any press-in protrusion. Of various embodiments of the present invention, in the electric connector of the first embodiment, the partition part 320 of the inner wall shell 300 is provided with a press-in protrusion 330, which extends towards the rear side and is to be pressed into the body 100. With this arrangement, the inner wall shell 300 can be fixed to the body 100 completely without leaving any play or the like between them. Hence the coupling strength between the inner wall shell 300 and the body 100 is much more enhanced in comparison with the conventional products, and the anti-prying strength against the prying forces exerted by the counterpart connectors 400 is much more enhanced, and the electric connector is more reliably prevented from being damaged.

Figure 9:
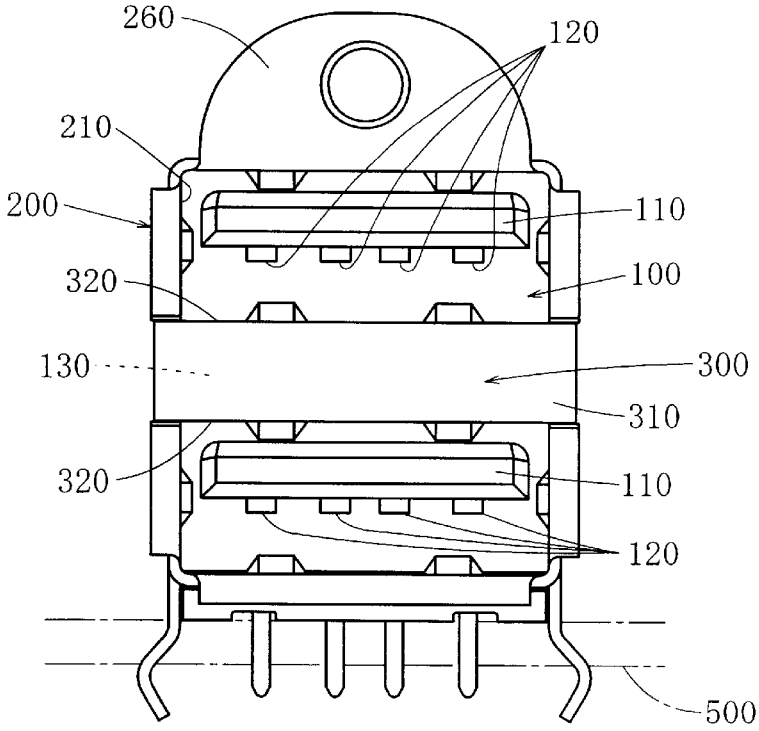
FIG. 9 is a figure of the electric connector of the second embodiment seen from the front side.
Figure 10:
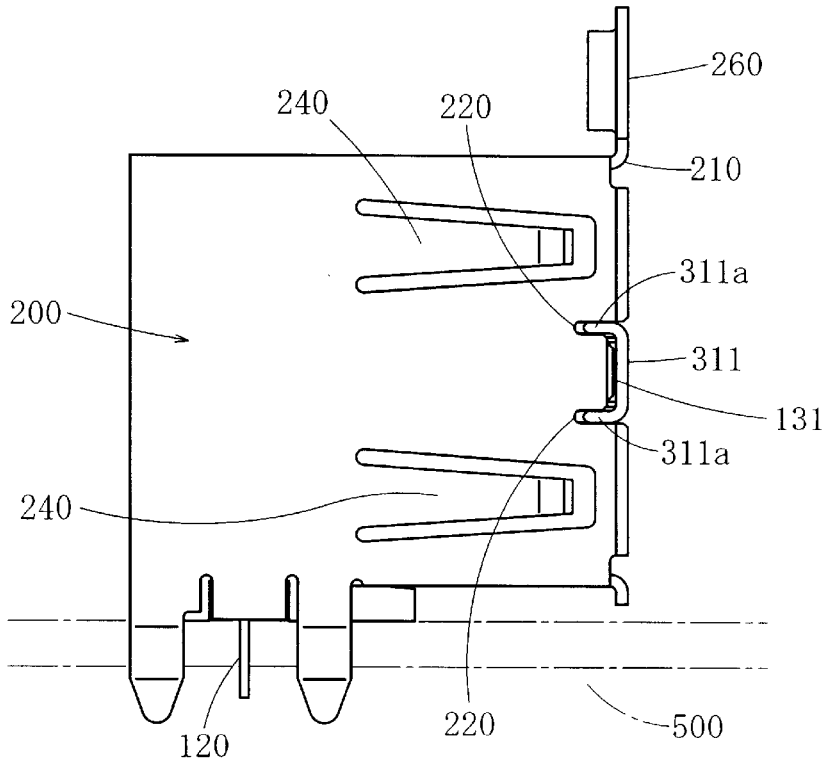
FIG. 10 is a figure of the electric connector of the second embodiment seen from one side in the width direction thereof.
Figure 11:
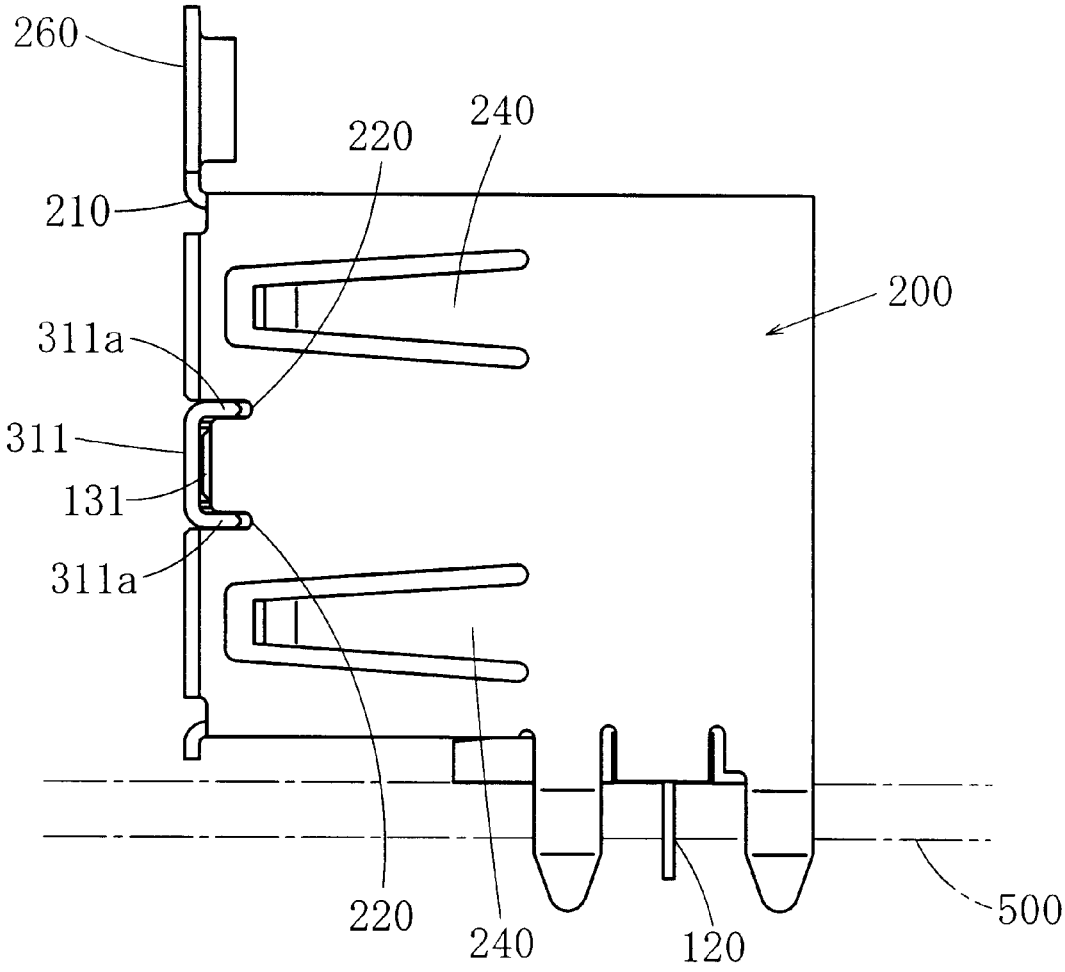
FIG. 11 is a figure of the electric connector of the second embodiment seen from the other side in the width direction thereof.

FIG. 9 through FIG. 11 show the electric connector of the second embodiment. Parts which exhibit functions similar to those of the electric connector of the first embodiment are given with the same marks and their descriptions will be omitted. In the above-mentioned electric connector of the first embodiment, one end, in the width direction, of the intermediate part 310 of the inner wall shell 300 is formed into the thrust-in part 311, and two top ends 311*a*, 311*a* of the thrust-in part 311 are fastened to two slits 220, 220 in the outer wall shell 200, and the fit-in tongue 312 at the other end thereof is fitted into the concave part 230 of the outer wall shell 200. In the second embodiment, both ends, in the width direction, of the intermediate part 310 of the inner wall shell 300 are formed into thrust-in parts 311, and two slits 220, which are cut towards the rear side, are formed in the front-side edges of both the walls, in the width direction, of the outer wall shell 200, and two top ends 311*a*, 311*a* of each thrust-in part 311 are fastened to the two slits 220, 220 of each wall of the outer wall shell 200. In this electric connector of the second embodiment, as the thrust-in parts 311 at both ends, in the width direction, of the intermediate part 310 of the inner wall shell 300 are fastened to the two slits 220, 220 of the outer wall shell 200, the coupling strength between the outer wall shell 200 and the inner wall shell 300 is enhanced much more than that of the first embodiment. Hence the anti-prying strength of the electric connector against the prying forces exerted by the counterpart connectors 400 is enhanced much more, and the electric connector is more reliably prevented from being damaged. When the electric connector of this second embodiment is to be mounted on a printed circuit board or the like with a face of the electric connector facing the board or the like, if both the ends, in the width direction, of the intermediate part 310 of the inner wall shell 300 protrude not only from both the ends, in the width direction, of the body 100 but also from both the ends, in the width direction, of the outer wall shell 200, interference between the thrust-in parts 311 and the printed circuit board or the like can be reliably prevented by mounting the electric connector on the printed circuit board with one face in the height direction thereof facing the printed circuit board or the like. FIG. 9 through FIG. 11 show such modes of use. The electric connector shown in FIG. 9 through FIG. 11 has a projection on the rear side portion of the face facing the printed circuit board or the like 500, hence there is a gap between the front side portion of the face and the printed circuit board or the like 500. If such a protrusion is not present, the face of the electric connector can be entirely brought to close contact with the printed circuit board or the like 500.

The structure for fastening an end of the intermediate part of the inner wall shell to the outer wall shell is not limited to the structure for fitting the fit-in tongue 312 into the concave part 230 of the outer wall shell 200 as is the case of the above-mentioned embodiment, the present invention includes other known fastening structures.

With the description of these embodiments, the first electric connector which was described in Summary of the Invention above has been fully disclosed. Moreover, with the description of these embodiments, the second electric connector and the third electric connector, which will be described below, have been fully described.

The second electric connector is the first electric connector wherein the body is provided with a partition wall which partitions the connection parts, and the inner wall shell is put on the partition wall so that the intermediate part shields the front side face of the partition wall and the partition parts cover both the faces, in the height direction, of the partition wall.

With this arrangement, when the inner wall shell is assembled onto the outer wall shell, the inner wall shell will be guided by the partition wall to enter from the front side towards the rear side. Hence the ease of assembling the inner wall shell onto the outer wall shell is enhanced. Moreover, when the partition wall is fitted into the inner wall shell, the coupling strength between the inner wall shell and the body will be enhanced much more, and the anti-prying strength against the prying forces exerted by the counterpart connectors will be enhanced much more, and in turn, the electric connector will be more reliably prevented from being damaged.

The third electric connector is the first or the second electric connector wherein the partition part of the inner wall shell is provided with a press-in protrusion which extends towards the rear side and is to be pressed into the body.

With this arrangement, the inner wall shell will be completely fixed to the body without leaving any play or the like. Hence the coupling strength between the inner wall shell and the body is enhanced much more in comparison with the conventional products, and the anti-prying strength against prying forces exerted by the counterpart connectors will be enhanced much more, and the electric connector is more reliably prevented from being damaged.

What is claimed is:

1. An electric connector having opposite front and rear sides and comprising a body made of an insulator, having connection parts arranged in stages in a height direction of the connector at the front side of the connector, the connection parts having terminals arranged thereon and being adapted to be connected with counterpart connectors, an outer wall shell made of a conductor, the outer wall shell being arranged on the body to shield the connection parts and having an opening at the front side of the connector and having two slits formed in the outer wall shell, and an inner wall shell made of a conductor, the inner wall shell being provided to partition the connection parts and comprising an intermediate part forming a front side face of the inner wall shell at the front side of the connector and partition parts extending toward the rear side of the connector from two opposite first ends, in the height direction, of the intermediate part, wherein the intermediate part of the inner wall shell further has two opposite second ends in a width direction of the connector transverse to the height direction, and wherein the two opposite second ends are extended and fastened to the outer wall shell, and at least one of the two opposite second ends is formed into an approximately-U-shaped thrust-in part projecting from the front side toward the rear side when seen in the width direction, and the thrust-in part includes two top ends that project toward the rear side of the connector and that are fastened into the two slits formed in the outer wall shell.

2. The electric connector as recited in claim 1, wherein the body further has a partition wall which partitions the connection parts and which has a front side face at the front side of the connector and two side faces respectively facing toward the connection parts, and the inner wall shell is put on the partition wall so that the intermediate part shields the front side face of the partition wall and the partition parts cover the two side faces of the partition wall.

3. The electric connector as recited in claim 2, wherein a respective one of the partition parts of the inner wall shell is provided with a press-in protrusion which extends toward the rear side and is pressed into an opening in the body.

4. The electric connector as recited in claim 1, wherein a respective one of the partition parts of the inner wall shell is provided with a press-in protrusion which extends toward the rear side and is pressed into an opening in the body.

* * * * *